US009863170B2

(12) United States Patent
Park et al.

(10) Patent No.: US 9,863,170 B2
(45) Date of Patent: Jan. 9, 2018

(54) STRUCTURE OF HOOD LATCH FOR VEHICLE

(71) Applicants: Hyundai Motor Company, Seoul (KR); Daedong Door Incorporated, Pyoungtak-shi, Kyounggi-do (KR)

(72) Inventors: Jung-Hun Park, Inchun-shi (KR); Seung-Jun Yang, Hwasung-shi (KR); Jeong-Min Eom, Inchun-shi (KR)

(73) Assignees: Hyundai Motor Company, Seoul (KR); Daedong Door Incorporated, Pyoungtak-shi (KR)

( * ) Notice: Subject to any disclaimer, the term of this patent is extended or adjusted under 35 U.S.C. 154(b) by 72 days.

(21) Appl. No.: 14/510,450

(22) Filed: Oct. 9, 2014

(65) Prior Publication Data

US 2015/0115625 A1 Apr. 30, 2015

(30) Foreign Application Priority Data

Oct. 31, 2013 (KR) ..... 10-2013-0130655

(51) Int. Cl.
*E05B 83/24* (2014.01)
*C06D 5/00* (2006.01)
(Continued)

(52) U.S. Cl.
CPC ..... *E05B 83/24* (2013.01); *E05B 77/08* (2013.01); *E05B 81/14* (2013.01); *Y10T 292/1043* (2015.04)

(58) Field of Classification Search
CPC ..... E05B 77/08; E05B 81/14; E05B 83/24; Y10T 292/1043
See application file for complete search history.

(56) References Cited

U.S. PATENT DOCUMENTS 8,573,658 B2 * 11/2013 Kim ..... B60R 21/34 292/201
8,579,068 B2 * 11/2013 Farooq ..... B60R 21/38 180/274

(Continued)

FOREIGN PATENT DOCUMENTS

JP 8-177283 A 7/1996
KR 10-1281462 B1 7/2013

OTHER PUBLICATIONS

Pushelement, (Oct. 1, 2013).

*Primary Examiner* — Matthieu F Setliff
*Assistant Examiner* — Thomas Neubauer
(74) *Attorney, Agent, or Firm* — Morgan, Lewis & Bockius LLP

(57) ABSTRACT

A structure of a hood latch may include a base plate attached to a front side of a vehicle body having a fixation groove to allow a striker coupled to a hood to enter the fixation groove, a latch in which a first end is hinge-coupled to a first side of the base plate and a hook is formed at a second end of the latch so as to hook the striker, a pawl in which a first end is hinge-coupled to a second side of the base plate, a second end is connected to and elastically supported by a second spring, and an engagement protrusion is provided to restrict movement of the latch, a bracket to be rotated in a clockwise and anti-clockwise direction, and an actuator connected to a first side of the bracket to move the bracket in left and right directions.

6 Claims, 7 Drawing Sheets

(51) Int. Cl.
*E05B 77/08* (2014.01)
*E05B 81/14* (2014.01)

(56) References Cited

U.S. PATENT DOCUMENTS

| | | | | |
|---|---|---|---|---|
| 9,145,716 | B2 * | 9/2015 | Jayasuriya | E05B 77/08 |
| 9,255,429 | B2 * | 2/2016 | Kim | E05B 83/24 |
| 9,340,179 | B2 * | 5/2016 | Kim | B60R 21/38 |
| 9,367,082 | B2 * | 6/2016 | Jau | G06F 1/16 |
| 2007/0246944 | A1 * | 10/2007 | Sundararajan | B60R 21/38 292/92 |

* cited by examiner

STRUCTURE OF HOOD LATCH FOR VEHICLE

CROSS-REFERENCE TO RELATED APPLICATIONS

The present application claims priority to Korean Patent Application No. 10-2013-130655, filed Oct. 31, 2013, the entire contents of which is incorporated herein for all purposes by this reference.

BACKGROUND OF THE INVENTION

Field of the Invention

The present invention relates to a hood latch provided at a front side of a vehicle, and more particularly, to a structure of a hood latch for a vehicle in which a latch is unlocked by bringing the other side of the bracket into contact with a lower end of a pawl to rotate the pawl as a bracket disposed at a lower part of the base plate is moved when a vehicle collides with a pedestrian and a striker protrudes upward to pop up a hood by bringing a bracket extending part into contact with a latch protrusion to rotate the latch.

Description of the Related Art

In general, a hood is attached to an upper part of an engine room disposed at a front side of a vehicle to open or close the engine room and to shut out engine noise by shielding the engine room.

In order to service various components provided within the engine room or to perform a general daily check, one side of the hood is hinge-coupled to a vehicle body, and a hood latch serving as a locking unit of the hood is attached to the other side to selectively open the hood.

The hood latch is typically a locking and unlocking means for opening or closing the hood. When the hood needs to be closed as usual or during traveling, the hood latch is configured as a secondary locking structure in which the hood is prevented from being opened to safely maintain a closed state. Further, the hood latch is positioned below a front end of the hood and is provided at the vehicle body, and functions to hold or release a striker attached to an inner panel of the hood.

Meanwhile, in recent years, a structure for reducing an injury of the pedestrian has been mostly provided at the front side of the vehicle with the hood as its center and a front bumper of the vehicle body, and this is an important factor for determining merchantability of the vehicle.

Europe's pedestrian protection is a method for evaluating performance of the front side of the vehicle by testing the impact of a leg form, an upper leg form and a head form substituted for the pedestrian hitting the front side of the stopped vehicle.

In general, when the vehicle collides with the pedestrian, the pedestrian falls down on a road in a vehicle traveling direction. At this time, the pedestrian is hit again by the vehicle and highly likely to die. Accordingly, a main object of regulations on pedestrian protection is to reduce mortality rates by such pedestrian accidents.

Particularly, when the pedestrian collides with the hood, it is necessary to form a buffer space between the hood and the engine in order to reduce impact applied to the body of the pedestrian and to absorb inertial energy of the body.

However, most vehicles are designed such that the hood is positioned as low as possible in order to secure a frontal visual field of a driver, and, thus, a gap between the engine and the hood is a minimum space so as to avoid interference.

Accordingly, in order to secure an additional buffer space, a method of deforming a shape of the hood or a method of instantaneously popping up the hood when impact is detected by a sensor is adopted.

In a structure of a hood latch for a vehicle according to the related art, when impact of a bumper of the vehicle is detected by a detecting sensor, an inflator is operated by exploding embedded gunpowder. Thus, a latch assembly is unlocked, and the entire latch assembly is popped up by a torsion spring positioned below the latch assembly.

However, in the structure of a hood latch for a vehicle according to the related art, since the inflator and the torsion spring are additionally provided to pop up the hood, manufacturing cost of the vehicle may be increased, and a weight of the vehicle may be increased. Further, the number of processes may be increased due to a complicated structure, and assembly time may be increased.

In the structure of a hood latch for a vehicle according to the related art, since the latch assembly is moved upward by only the torsion spring, malfunction may be caused, and since there is no means for maintaining the latch assembly in the popup state, it may be difficult for the body of the pedestrian from being secondarily hit by the engine.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a structure of a hood latch for a vehicle with which it is possible to reduce manufacturing cost and assembly time and to improve pedestrian protecting performance by popping up a hood by the structure of a hood latch having a simple configuration when a vehicle collides with a pedestrian.

In an aspect of the present invention, a structure of a hood latch for a vehicle, the structure may include a base plate attached to a front side of a vehicle body having a fixation groove formed at an upper end so as to allow a striker coupled to a hood to enter the fixation groove, a latch in which a first end is hinge-coupled to a first side of the base plate and a hook is formed at a second end of the latch so as to selectively hook the striker, wherein the latch is elastically supported by a first elastic member, a pawl in which a first end is hinge-coupled to a second side of the base plate, a second end is connected to and elastically supported by a second elastic member, and an engagement protrusion is provided to selectively restrict movement of the latch, a bracket disposed adjacent to a lower part of the pawl and selectively rotating the pawl in a clockwise and anti-clockwise direction, and an actuator that is connected to a first side of the bracket to move the bracket in left and right directions, wherein the actuator is operated to move the bracket by a signal of a detecting sensor provided at a front side of the vehicle when the vehicle collision occurs, and wherein the latch is unlocked from the pawl to pop up the hood by moving the bracket to actuate the lower part of the pawl in a direction of the left and right directions.

The structure may include a latch protrusion that protrudes from a lower end of the latch to extend downward, and a bracket extending part that protrudes from the first side of the bracket to selectively come in contact with the latch protrusion, wherein the latch is unlocked by moving the bracket to actuate the lower end of the pawl to rotate the pawl as the bracket is moved.

The striker is moved upward to pop up the hood by moving the bracket extending part toward the latch protrusion to actuate the latch protrusion and thus to rotate the latch.

A gap is formed between the latch protrusion and the bracket extending part, and unlocking of the latch by a rotation of the pawl and protruding of the striker by a rotation of the latch are performed in sequence due to closing of the gap by the latch protrusion and the bracket extending part coming into contact with each other.

The bracket may have a 'U' shape in which a first end of the bracket is bent upward to extend up to a position relatively higher than the lower end of the latch and a second end of the bracket is bent upward to extend up to a position relatively higher than the lower end of the pawl.

The actuator is a gunpowder type actuator operated by exploding embedded gunpowder by the signal of the detecting sensor provided at the front side of the vehicle.

The actuator may include a plurality of vent holes formed within the actuator to allow gas to pass, and after the vehicle collides with a pedestrian, the hood is lowered by discharging the gas within the actuator through the vent holes.

According to various embodiments of the present invention, since the bracket that is disposed adjacent to the lower part of the pawl to be moved in the left and right direction by the actuator rotates the pawl to unlock the latch, it is possible to improve pedestrian protecting performance and to reduce the number of processes and assembly time.

Unlike the structure of a hood latch for a vehicle in the related art, since it is not necessary to additionally provide a torsion spring, manufacturing cost of the vehicle can be reduced, and a weight of the vehicle can be reduced to improve fuel efficiency of the vehicle.

As the bracket is moved, the pawl is rotated to unlock the latch. Subsequently, the bracket rotates the latch to allow the striker to be moved upward, and the hood is popped up. Accordingly, the unlocking of the latch and the popping up of the hood can be performed at the same time by one component (bracket).

Since the bracket is maintained in the hood popup state, it is possible to prevent a body of the pedestrian from being secondarily injured by being hit by an engine. Further, since the vent holes are formed in the actuator, the hood is slowly lowered after the collision, so that the pedestrian protecting performance can be improved.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
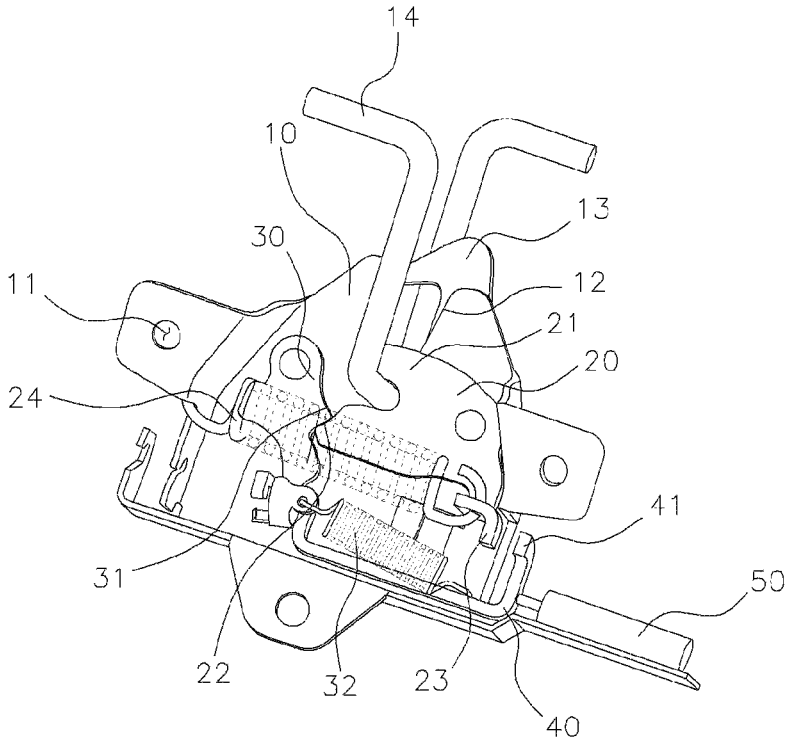
FIG. 1 is a perspective view illustrating a state where a latch is locked by a pawl in an exemplary structure of a hood latch for a vehicle according to the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

A structure of a hood latch for a vehicle according to an exemplary embodiment of the present invention includes a base plate 10 that is attached to a front side of a vehicle body and has a fixation groove 12 formed at an upper end so as to allow a striker 14 coupled to a hood to enter, a latch 20 in which one end is hinge-coupled to one side of the base plate 10 and a hook 21 is formed at the other end so as to hook the striker 14, and that is elastically supported by a first spring 24, a pawl 30 in which one end is hinge-coupled to the other side of the base plate 10, the other end is connected to a second spring 32 to be elastically supported, and an engagement protrusion 31 is provided to restrict movement of the latch 20, a bracket 40 that is disposed adjacent to a lower part of the pawl 30 to be moved in a left and right direction, and an actuator 50 that is connected to one side of the bracket 40 to move the bracket in the left and right direction. The actuator 50 is operated by a signal of a detecting sensor provided at a front side of a vehicle to move the bracket 40 when the vehicle collides with a pedestrian, and the latch 20 is unlocked to pop up the hood by bringing the other side of the bracket 40 into contact with a lower end of the pawl 30 to rotate the pawl 30.

As illustrated in FIG. 1, assembly holes 11 are formed at both sides and a lower side of the base plate 10 so as to allow the base plate to be assembled with an internal vehicle body of an engine room of a front side of the hood, and the fixation groove 12, that is cut off in an up and down direction so as to allow the striker 14 described below to enter, is formed at an upper end of the base plate 10.

Figure 2:
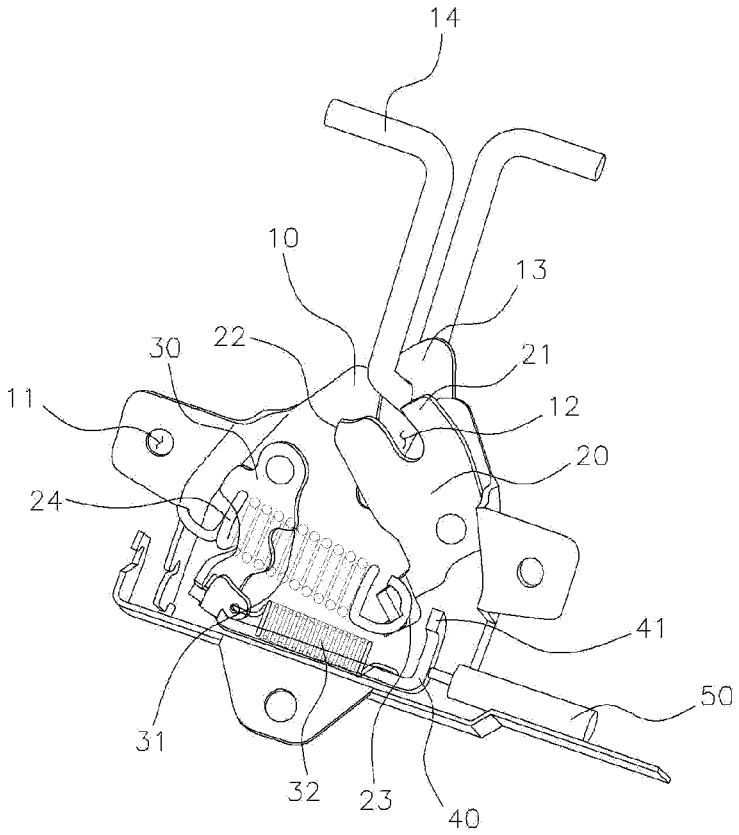
FIG. 2 is a perspective view illustrating a state where the latch is unlocked to protrude a striker upward in the exemplary structure of the hood latch for the vehicle according to the present invention.

The striker 14 is integrally connected to the hood to move the hood in the up and down direction, and has a 'U' shape in which a center is bent so as to be hooked to a safety hook 13 coupled to an upper part of the base plate 10, as illustrated in FIG. 2.

As illustrated in FIG. 1, the latch 20 is hinge-coupled to the one side of the base plate 10 to be rotated, and in the shown embodiments, the hook 21 protrudes from a left side of the latch 20 so as to allow the striker 14 to be inserted.

A width between the sides of the hook 21 where the striker 14 is inserted may be equal to or slightly larger than a cross-section diameter of the striker 14. As illustrated in FIG. 1, when the latch 20 is locked by the pawl 30 described below, the striker 14 is inserted into the hook 21, and as illustrated in FIG. 2, when the latch 20 is unlocked, the striker 14 protrudes upward by rotation of the hook 21.

As illustrated in FIG. 1, the first spring 24 is connected to the latch 20 in order to provide elastic restoring force to the latch 20. In the shown embodiments, and one end of the first spring 24 is coupled to a side of the base plate, and the other end thereof is coupled to a right lower end of the latch 20.

The first spring 24 is a tensile spring serving to provide elastic force to the latch 20 such that when the latch 20 is unlocked, the striker 14 is moved upward by clockwise rotation of the latch 20.

The left, right, up and down directions described in the present specification are set to describe the shown embodiments, and when a coupling direction of the base plate 10, a disposing state of the latch 20, and a structure of the hood latch are illustrated in a direction opposite to the direction in the shown exemplary embodiment, the structure of the hood latch may be changed and the direction thereof may be changed depending on conditions.

As illustrated in FIG. 1, the pawl 30 is hinge-coupled to the other side of the base plate 10 to be rotated, and in the shown embodiments, the engagement protrusion 31 that restricts the latch 20 so as not to move the latch 20 in the locked state is formed to protrude from a right side of the pawl 30.

As illustrated in FIG. 1, when the latch 20 is locked so as not to pop up the hood, the engagement protrusion 31 formed at the pawl 30 comes in contact with an engagement part 22 formed to protrude from a left side of the latch 20 to prevent the latch 20 from being rotated.

As illustrated in FIG. 2, when the pawl 30 is moved to the left side by the bracket 40 described below to cut off the contact between the engagement protrusion 31 and the engagement part 22, the latch 20 rotates in a clockwise direction, and the striker 14 protrudes upward by the rotation of the latch 20.

As illustrated in FIG. 1, in order to provide the elastic force such that the pawl 30 is constantly pulled to the right side to restrict the latch 20, the second spring 32 is connected to the pawl 30. In the shown embodiments, one end of the second spring 32 is coupled to the lower end of the pawl 30, and the other end thereof is coupled to a lower end of the base plate 10.

Figure 3A:
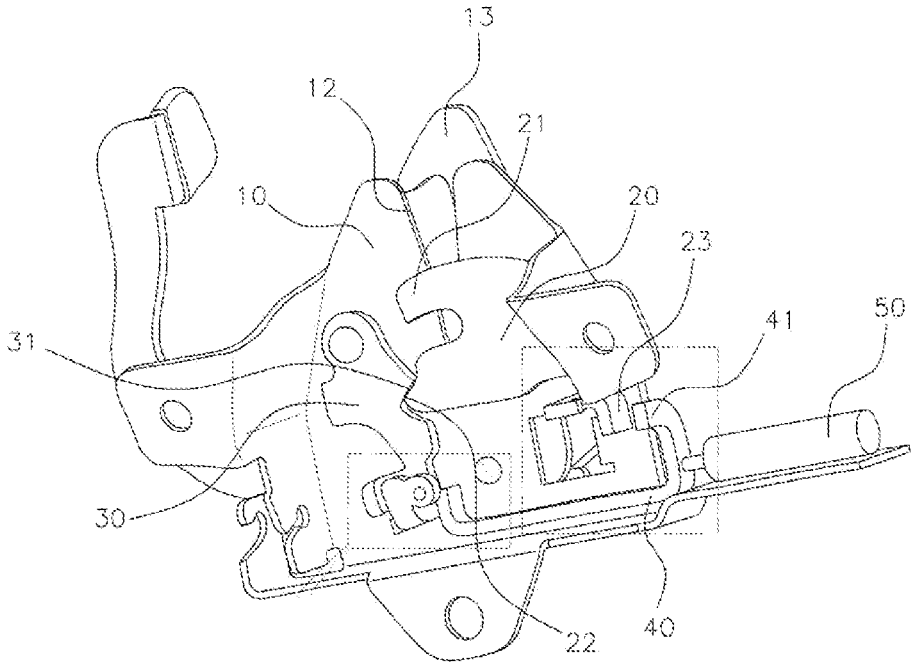
FIG. 3A is a perspective view illustrating a state where a first spring and a second spring are removed in the exemplary structure of the hood latch for a vehicle according to the present invention.
Figure 3B:
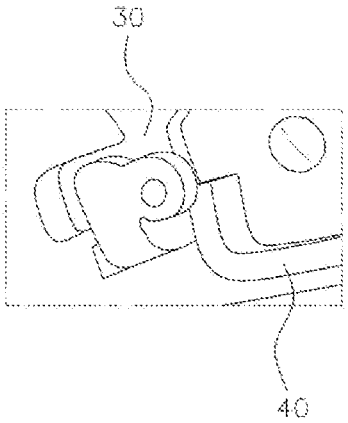
FIG. 3B is a perspective view illustrating a state where a first spring and a second spring are removed in the exemplary structure of the hood latch for a vehicle according to the present invention.
Figure 3C:
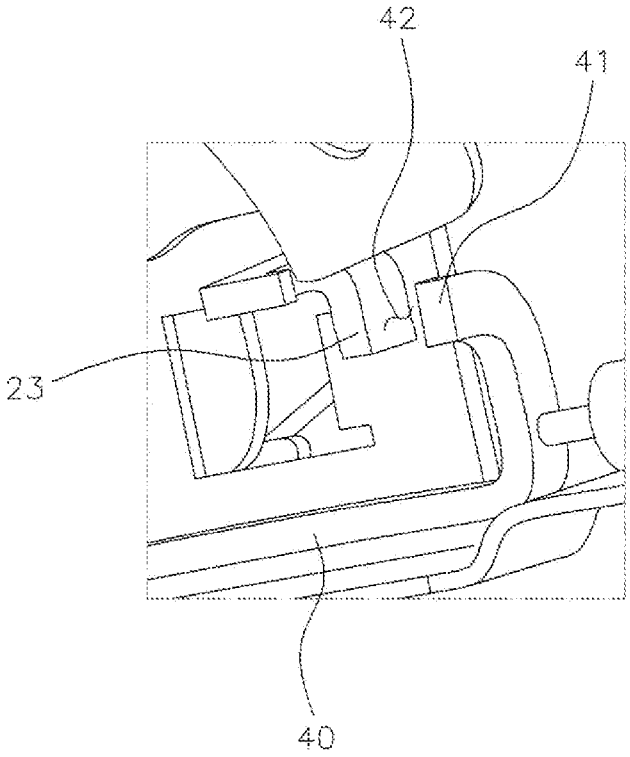
FIG. 3C is a perspective view illustrating a state where a first spring and a second spring are removed in the exemplary structure of the hood latch for a vehicle according to the present invention.

As illustrated in FIGS. 3A-3C, the bracket 40 is provided below the pawl 30 and the latch 20 so as to move in the left and right direction to push the pawl 30 to the right side, so that the latch 20 is unlocked.

A latch protrusion 23 protrudes from a right lower end of the latch 20 to extend downward, and a bracket extending part 41 protrudes from a right end of the bracket 40 to extend forward.

The bracket extending part 41 is overlapped with the latch protrusion 23 such that as the bracket 40 is moved to the left side, the bracket extending part comes in contact with the latch protrusion 23.

Figure 5:
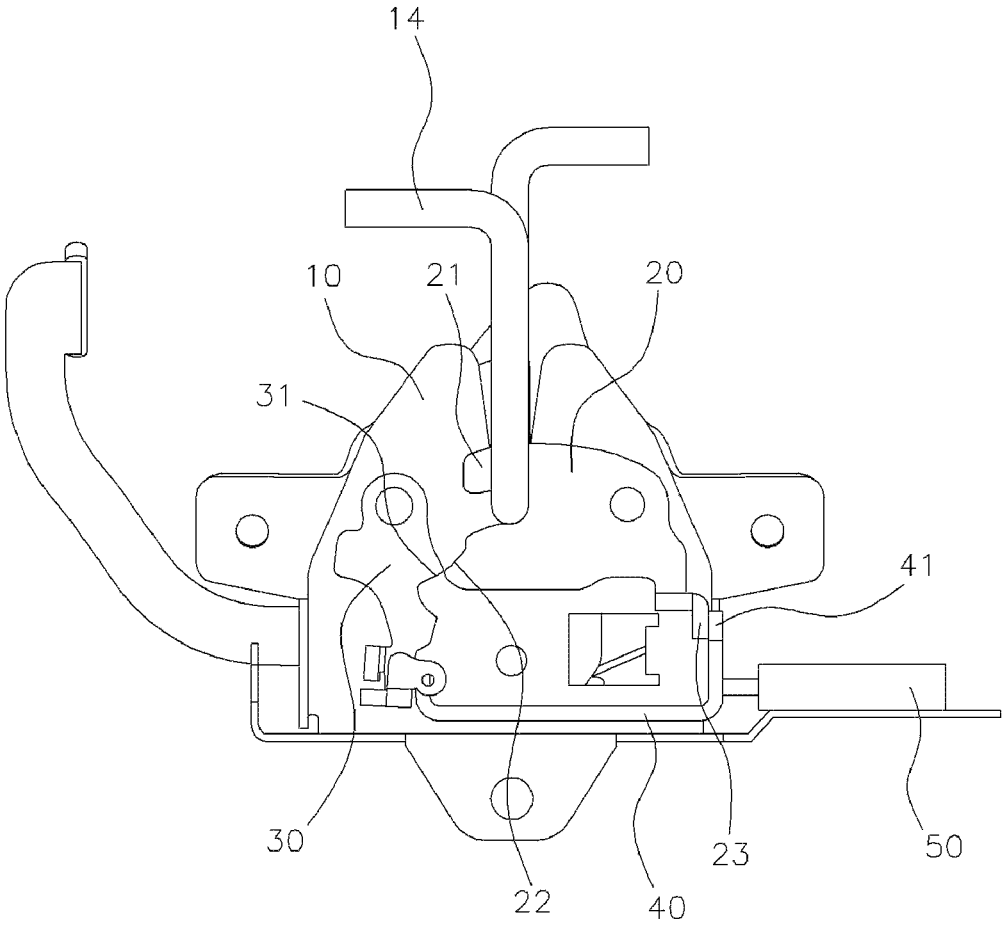
FIG. 5 is a front view illustrating a state where the bracket rotates the pawl to unlock the latch in the exemplary structure of hood latch for the vehicle according to the present invention.
Figure 6:
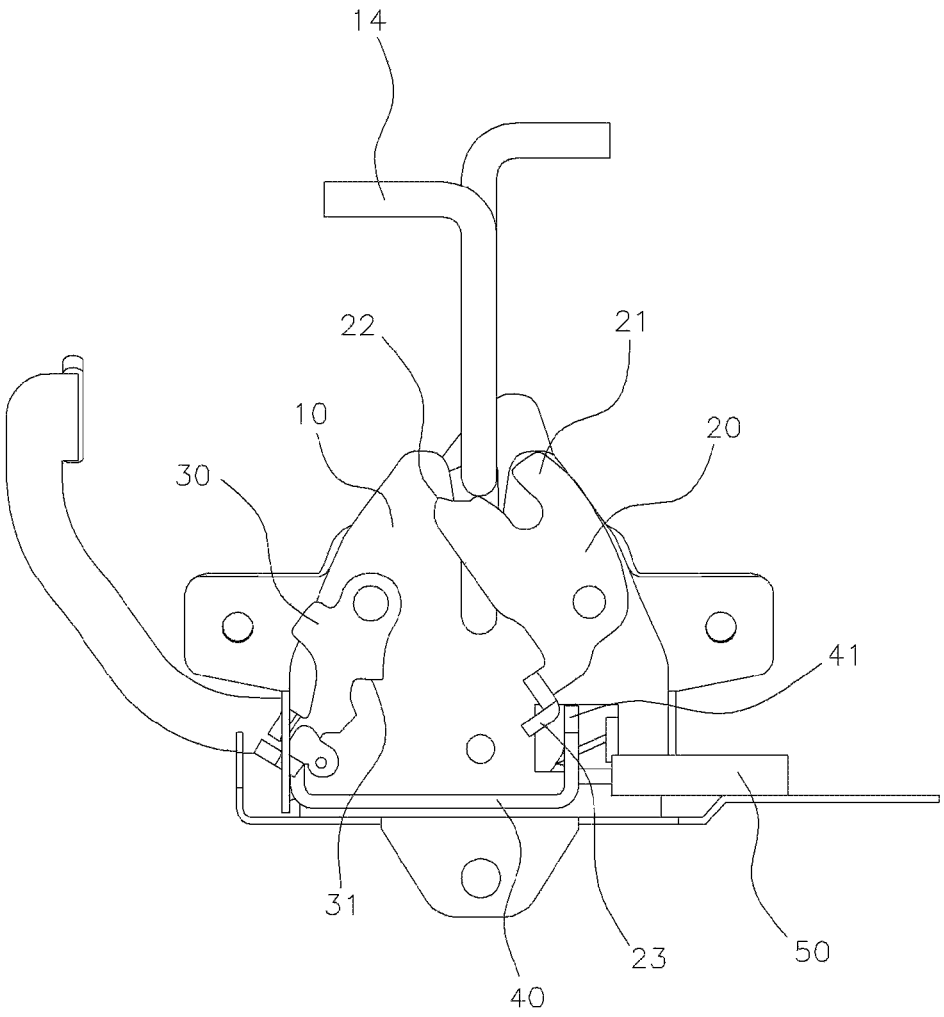
FIG. 6 is a front view illustrating a state where the bracket rotates the latch to protrude the striker upward in the exemplary structure of the hood latch for a vehicle according to the present invention.

That is, as illustrated in FIG. 5, as the bracket 40 is moved to the left side, a left end of the bracket 40 rotates the pawl 30 in the clockwise direction to unlock the latch 20. As illustrated in FIG. 6, the bracket extending part 41 pushes the latch protrusion 23 to rotate the latch 20 in the clockwise direction, so that the striker 14 and the hood connected to the striker 14 are moved upward.

Figure 4:
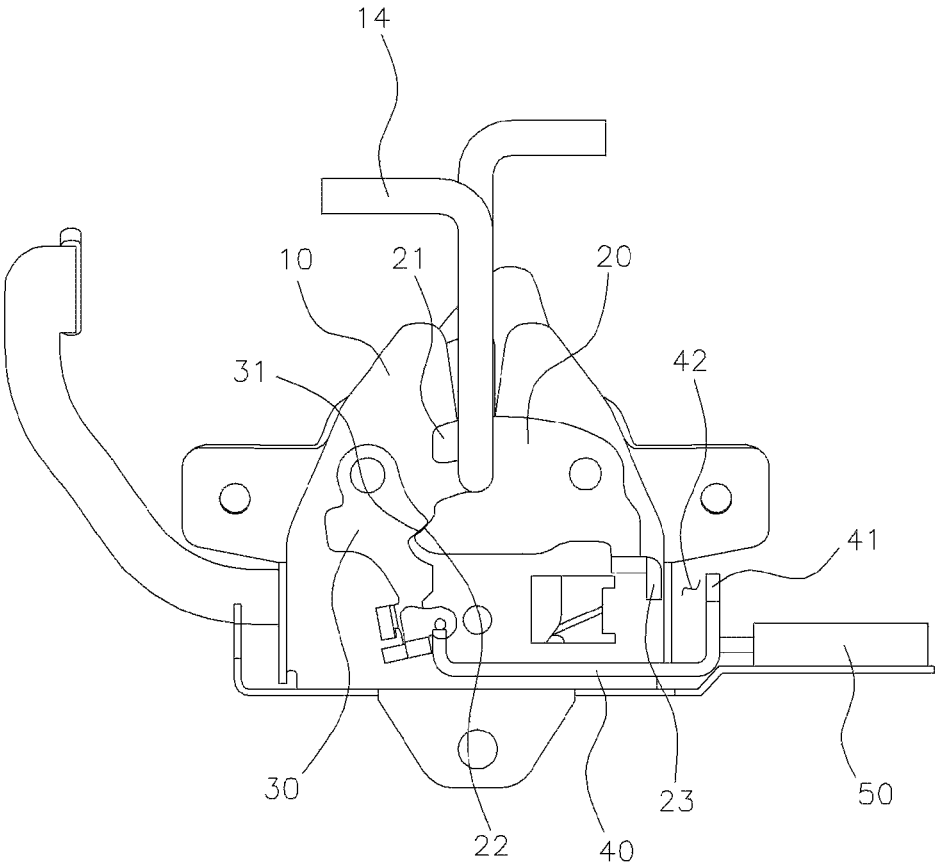
FIG. 4 is a front view illustrating a state where a bracket comes in contact with the pawl in the exemplary structure of the hood latch for the vehicle according to the present invention.

As illustrated in FIG. 4, a gap 42 is formed between the latch protrusion 23 and the bracket extending part 41. Specifically, as illustrated in FIG. 5, the gap 42 is set such that the bracket extending part 41 comes in contact with the latch protrusion 23 at the same time when the latch 20 is unlocked by calculating a point of time for unlocking the latch 20 by the rotation of the pawl 30.

That is, the gap 42 is preferably set to the same distance as a distance by which the engagement protrusion 31 formed at the pawl 30 is moved in an arc shape on the engagement part 22 formed at the latch 20.

As stated above, by forming the gap 42 between the latch protrusion 23 and the bracket extending part 41, the latch 20 is unlocked by the clockwise rotation of the pawl 30, and then the bracket extending part 41 pushes the latch protrusion 23 to allow the striker 14 to protrude by the clockwise rotation of the latch 20.

As illustrated in FIGS. 3A-3C, the bracket 40 may have a 'U' shape in which the right end extends to be bent upward up to a position relatively higher than the lower end of the latch 20 and the left end extends to be bent upward up to a position relatively higher than the lower end of the pawl 30.

That is, the lower end of the latch 20 and the lower end of the pawl 30 are respectively overlapped with the right end of the bracket 40 and the left end of the bracket 40 respectively to allow the latch 20 and the pawl 30 to be rotated by the movement of the bracket 40.

The actuator 50 is connected to a right side of the bracket 40 to provide force allowing the bracket 40 to be moved in the left and right direction.

That is, the actuator 50 is operated by the signal of a detecting sensor provided at the front side of the vehicle when the vehicle collides with the pedestrian, and the bracket 40 is moved to the left side along with the operation of the actuator 50 to rotate the pawl 30 and the latch 20.

The actuator 50 is classified as a gunpowder type actuator that moves the bracket 40 by momentum gained by exploding embedded gunpowder and a solenoid type actuator that moves the bracket 40 by magnetism through a solenoid (an electromagnet) according to an operation method.

In comparison to the solenoid type actuator, the gunpowder type actuator 50 used in the present invention has a simple configuration and a low malfunction occurrence probability and can reduce manufacturing cost.

The actuator 50 according to various embodiments of the present invention may further include a plurality of bent holes formed within the actuator 50 so as to allow a gas to pass.

That is, since the vent holes are included within the actuator 50 as stated above, when the striker 14 is returned to its initial state after protruding, the gas within the actuator 50 is discharged through the vent holes, so that the hood is slowly lowered. As a result, the pedestrian is not hit by the engine room, and impact given to the pedestrian can be dispersed.

Similar to a typical vent hole, the vent holes are formed in various shapes within the actuator 50 to slowly discharge the gas generated by the explosion of the gunpowder.

An operating procedure of the structure of the exemplary hood latch for a vehicle according to the present invention is as follows.

As illustrated in FIG. 4, the latch 20 is constantly fixed in a non-rotation state (a latch locking state) where the engagement part 22 is hooked to the engagement protrusion 31 of the pawl 30, and the striker 14 connected to the hood is hooked to the hook 21 of the latch 20 to fix the hood so as not to pop up the hood.

As illustrated in FIG. 5, when the detecting sensor provided at the front side of the vehicle detects the collision with the pedestrian, the actuator 50 moves the bracket 40 to the left side by the signal of the detecting sensor, and the pawl 30 is rotated in the clockwise direction along with the movement of the bracket 40 to allow the engagement protrusion 31 to be separated from the engagement part 22 (a latch unlocking state).

Thereafter, as illustrated in FIG. 6, the bracket 40 is further moved to the left side to rotate the latch 20 in the clockwise direction, the striker 14 hooked to the hook 21 of the latch 20 protrudes upward by the rotation of the latch 20, and the hood connected to the striker 14 also protrudes upward (a hood popup state).

At this time, the bracket 40 supports the latch 20 so as to allow the striker 14 to be instantaneously maintained in the protruding state. Subsequently, as the gas within the actuator 50 is discharged through the vent holes of the actuator 50, the hood connected to the striker 14 is slowly lowered.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A structure of a hood latch for a vehicle, the structure comprising:

a base plate attached to a front side of a vehicle body and having a fixation groove formed at an upper end so as to allow a striker coupled to a hood to enter the fixation groove;

a latch in which a first end is hinge-coupled to a first side of the base plate and a hook is formed at a second end of the latch so as to selectively hook the striker, wherein the latch is elastically supported by a first elastic member;

a pawl in which a first end is hinge-coupled to a second side of the base plate, a second end is connected to and elastically supported by a second elastic member, and an engagement protrusion is provided to the pawl to selectively restrict movement of the latch;

a bracket disposed adjacent to a lower part of the pawl and the latch and selectively rotating the pawl and the latch in a clockwise and anti-clockwise direction; and an actuator that is connected to a first side of the bracket to move the bracket in left and right directions, wherein the actuator is operated to move the guide by a signal of a detecting sensor when the vehicle collision occurs, and wherein the latch is unlocked from the pawl when the actuator is operated to move the guide to rotate the pawl and the latch and the striker is moved upward to pop up the hood according to rotation of the latch, wherein the bracket has a 'U' shape in which a first end of the bracket is bent upward to extend up to a position higher than the lower end of the latch and to be selectively engaged to the lower end of the latch according to movement of the bracket, and a second end of the bracket is bent upward to extend up to a position higher than the lower end of the pawl, and wherein the second end of the bracket rotates the pawl to unlock the latch and the first end of the bracket rotates the latch to move the striker upward when the actuator is operated.

2. The structure of claim 1, further comprising:

a latch protrusion that protrudes from the lower end of the latch to extend downward; and a bracket extension part that protrudes from the first side of the bracket to selectively come in contact with the latch protrusion, wherein the latch is unlocked by moving the bracket to actuate the lower end of the pawl to rotate the pawl as the bracket is moved.

3. The structure of claim 2, wherein the striker is moved upward to pop up the hood by moving the bracket extension part toward the latch protrusion to actuate the latch protrusion and thus to rotate the latch.

4. The structure of claim 2, wherein a gap is formed between the latch protrusion and the bracket extension part, and unlocking of the latch by a rotation of the pawl and protruding of the striker by a rotation of the latch are performed in sequence due to closing of the gap by the latch protrusion and the bracket extension part coming into contact with each other.

5. The structure of claim 1, wherein the actuator is a gunpowder type actuator operated by exploding embedded gunpowder by the signal of the detecting sensor provided at the front side of the vehicle.

6. The structure of claim 1, wherein the actuator includes a plurality of vent holes formed within the actuator to allow gas to pass, and after the vehicle collides with a pedestrian, the hood is lowered by discharging the gas within the actuator through the vent holes.

* * * * *